United States Patent [19]

Banolas de Ayala

[11] 4,247,268

[45] Jan. 27, 1981

[54] ROTARY VANE MACHINE WITH RADIAL VANE CONSTRAINING MEMBERS

[76] Inventor: Maria P. Banolas de Ayala, Calle Templarios, 1, Lerida, Spain

[21] Appl. No.: 853,537

[22] Filed: Nov. 21, 1977

[30] Foreign Application Priority Data

Nov. 30, 1976 [ES] Spain ..... 453.810

[51] Int. Cl.[3] ..... F01C 1/00; F01C 21/00

[52] U.S. Cl. ..... 418/256; 418/173

[58] Field of Search ..... 418/253, 256, 173

[56] References Cited

U.S. PATENT DOCUMENTS

| | | | |
|---|---|---|---|
| 1,204,535 | 11/1916 | Augustine | 418/256 |
| 2,264,616 | 12/1941 | Buckbee | 418/256 |
| 2,590,728 | 3/1952 | Scognamillo | 418/256 |

FOREIGN PATENT DOCUMENTS

| | | | |
|---|---|---|---|
| 417493 | 8/1925 | Fed. Rep. of Germany | 418/173 |
| 605595 | 2/1926 | France | 418/256 |
| 244001 | 10/1925 | United Kingdom | 418/256 |
| 259346 | 10/1926 | United Kingdom | 418/256 |
| 266698 | 9/1927 | United Kingdom | 418/256 |
| 284362 | 1/1928 | United Kingdom | 418/256 |

*Primary Examiner*—John J. Vrablik

*Attorney, Agent, or Firm*—Steinberg & Raskin

[57] ABSTRACT

Constraining rings are provided in a fluid displacement machine of the kind in which an eccentrically mounted rotor revolves within a hollow chamber and is equipped with radially displaceable vanes to contact the wall of the chamber and separate working spaces of the machine. The constraining rings surround lugs in the vanes and limit outward centrifugal displacement of the vanes to prevent excessive contact pressure between the vanes and the wall of the chamber. Recesses for the rings may be provided in the ends of the vanes or the rotor may have end pieces sealingly engaging the ends of the hollow chamber and incorporating cavities to accommodate the rings and lugs. To center the rings they may be formed as the inner rings of bearings whose outer rings are fast with the ends of the chamber. Stress may be distributed by providing additional rings intermediately along the axial length of the vanes. Runners may be interposed between the lugs and the rings. The hollow chamber may deviate from cylindrical to conform to the shape generated by the vanes, or the circumferential edges of the vanes may be formed by enlarged heads which always present a generatrix to contact the chamber wall.

2 Claims, 12 Drawing Figures

ROTARY VANE MACHINE WITH RADIAL VANE CONSTRAINING MEMBERS

BACKGROUND OF THE INVENTION (1) Field of the Invention

This invention relates to fluid displacement machines, also known as volumetric machines, in which a rotor is mounted for rotation within a substantially cylindrical hollow chamber, the rotor being mounted for rotation about about an eccentric axis so that the rotor is contiguous with the chamber wall along a generatrix. The chamber wall constitutes the stator of the machine, and one or more working spaces are then formed between the internal surfaces of the hollow chamber and the outer surface of the rotor. More specifically, the invention is concerned with machines in which the rotor is equipped with a number of radial, or substantially radial, vanes which contact the wall of the chamber so as to separate a number of working spaces which, during rotation of the rotor, move around the chamber while periodically varying in volume between inlet and outlet ports for a driving or driven fluid. Examples of such machines are motors, compressors or vacuum pumps which operate with fluid gases, pumps or hydrodynamic motors which operate with liquids and internal combustion engines. A substantial variety of such machines are commerically available.

(2) Description of the Prior Art

In machines of the above type which are intended to work at relatively low speeds of rotation the vanes are urged outwardly against the cylindrical surface of the chamber by means of springs contained in the rotor itself. When the speed of rotation is higher the centrifugal force acting on the vanes, which of course rotate with the rotor, is sufficient to maintain the circumferential edges of the vanes in contact with the wall of the chamber. This is satisfactory when speeds are moderate and lubrication conditions are optimum. However it is not satisfactory for yet faster machines because the centrifugal force is still greater and drives the vanes against the wall of the chamber so forcefully that friction causes unacceptable wear to the equipment and unacceptable losses of energy.

SUMMARY OF THE INVENTION

An object of the present invention is to improve the system by which the vanes are mounted in a fluid displacement machine of the type set forth above, with the aim of reducing or substantially eliminating these deleterious effects of friction.

To this end, the invention provides an improvement comprising constraining members displaceable relative to the rotor and operatively associated with the vanes to limit outward radial displacement of them, the constraining members determining limit positions for the vanes in which the circumferential edges of the vanes make only a desired degree of contact with the substantially cylindrical chamber wall. Thereby excessive contact pressure between the chamber wall and the vanes is penetrated. At most, there should be smooth frictional contact. The constraining members absorb the effect due to centrifugal force outside the region of contact between the vanes and the chamber wall. This contact is also rendered more functional.

In a preferred form of the invention each vane has a lug at a radially inward position at both axially opposite ends of the vane, each lug having an edge facing radially outwardly which provides an abutment surface spaced inwardly from the circumferential edge of the vane, and constraining members are provided by rings each surrounding the lugs at a respective end of the vanes, with the abutment surfaces bearing directly or indirectly against the internal surfaces of the rings. The vanes may retain freedom to rock relative to the rings.

A cavity to accommodate the assembly of ring and lugs at each end of the rotor may be defined in the interface of the end of the rotor with the adjacent end wall of the hollow chamber. Such cavities may be entirely formed in the end face of the rotor, in which case each vane may have a recess in each of its axially opposite ends, each recess defining a lug in the end of the vane radially inwardly of the recess, the radially outwardly facing edge of the lug bounding the recess and providing an abutment surface. The constraining rings are then received in these recesses, possibly in such a way as to permit relative rocking motion between the vanes and the rings. The rings may be flush with the ends of the vanes, so that each ring and the vane ends flush with it sweep out, during rotation, a continuous smooth surface to lie directly adjacent a smooth end wall of the hollow chamber.

However, in a preferred form of the invention, the rotor includes a pair of spaced apart end pieces sealingly engaging the end walls of the hollow chamber with the vanes extending between these end pieces, the lugs projecting axially from the opposite ends of the vanes, the assembly constituted by each ring and the lugs which it surrounds then being accommodated in an associated cavity which is formed in the adjacent rotor end piece.

If necessary, for example for high working speeds, one or more additional constraining rings may be provided intermediately between the ends of the rotor. Such rings can fit within cut-outs of appropriate shape extending into the vanes from their radially inner edges and can be accommodated in associated annular cavities of the rotor. For this the rotor may be constituted by two or more subsections having transverse separation interfaces, such an interface being aligned with each additional ring with the cavity to accommodate the ring formed in the interface.

Ideally the constraining rings should be maintained in a fixed position and if necessary means may be provided for supporting them from the fixed structure of the fluid displacement machine. For this, each constraining ring may be the inner ring of a bell, roller or needle bearing whose outer part is accommodated in a seating on a fixed part of the machine such as the adjacent end wall of the hollow chamber.

In certain instances, for example for high working speeds, sliding bearing means may be interposed between each constraining ring and the lugs of the vanes which bear against that ring. In a preferred embodiment of this use is made of runners each having an arcuate face constituting a skid to slide over the internal surface of a constraining ring, and an opposite face with an axially extending groove to be engaged by an axially extending apex on the abutment surface of a lug, so that knife edge bearing is formed. Preferably the arcuate faces of the runners and the internal surfaces of the rings have mating projections and recesses to limit or prevent relative axial movement between the rings and the runners. One of the co-operating surfaces, for instance the internal surfaces of the rings, may be of channel section while the other has a profile of complementary shape.

Because the rotor is eccentric relative to the hollow chamber in which it rotates, the vanes are only truly radial, relative to the chamber, in two angular positions, namely when they lie in the plane containing the axes of the rotor end of the chamber. In other angular positions they are not radial, relative to the chamber (although they are radial relative to the rotor) and because their radially outward movement is limited by the constraining means, their circumferential edges do not generate a strictly cylindrical surface during rotation. In other words the circumferential edges of the vanes do not exactly coincide with the internal surface of the hollow chamber. In the majority of practical applications the play which is consequently present between the machine parts is of no particular importance but, if need be, the machine may be designed taking this aspect into account. One expedient consists in machining the inner surface of the stator in such a way that it better conforms to the surface actually generated by the circumferential edges of the vanes. Alternatively, the circumferential edges of the vanes may be enlarged, and their circumferential contact surfaces given a profile which suffices to ensure the required closure, in which case—if the weight of the vanes has to be kept low—these vanes may be generally T-shaped in section, the vertical leg of the T forming the body proper of the vane.

DESCRIPTION OF PREFERRED EMBODIMENTS

Figure 1A:
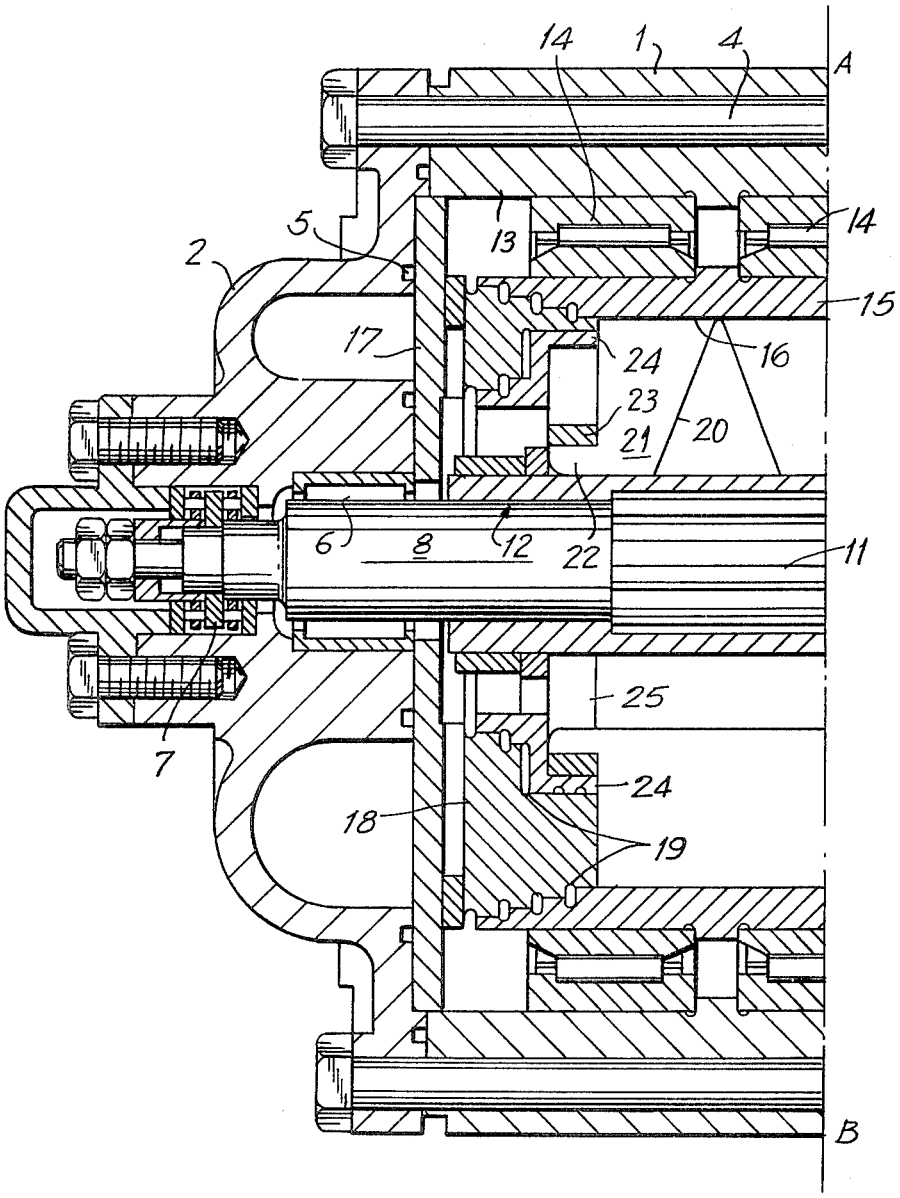
FIG. 1 is an axial cross-section through a volumetric compressor for gases, embodying the invention; for the sake of clarity this Figure is subdivided into two parts A and B which join at the cross-section line A–B.
Figure 1B:
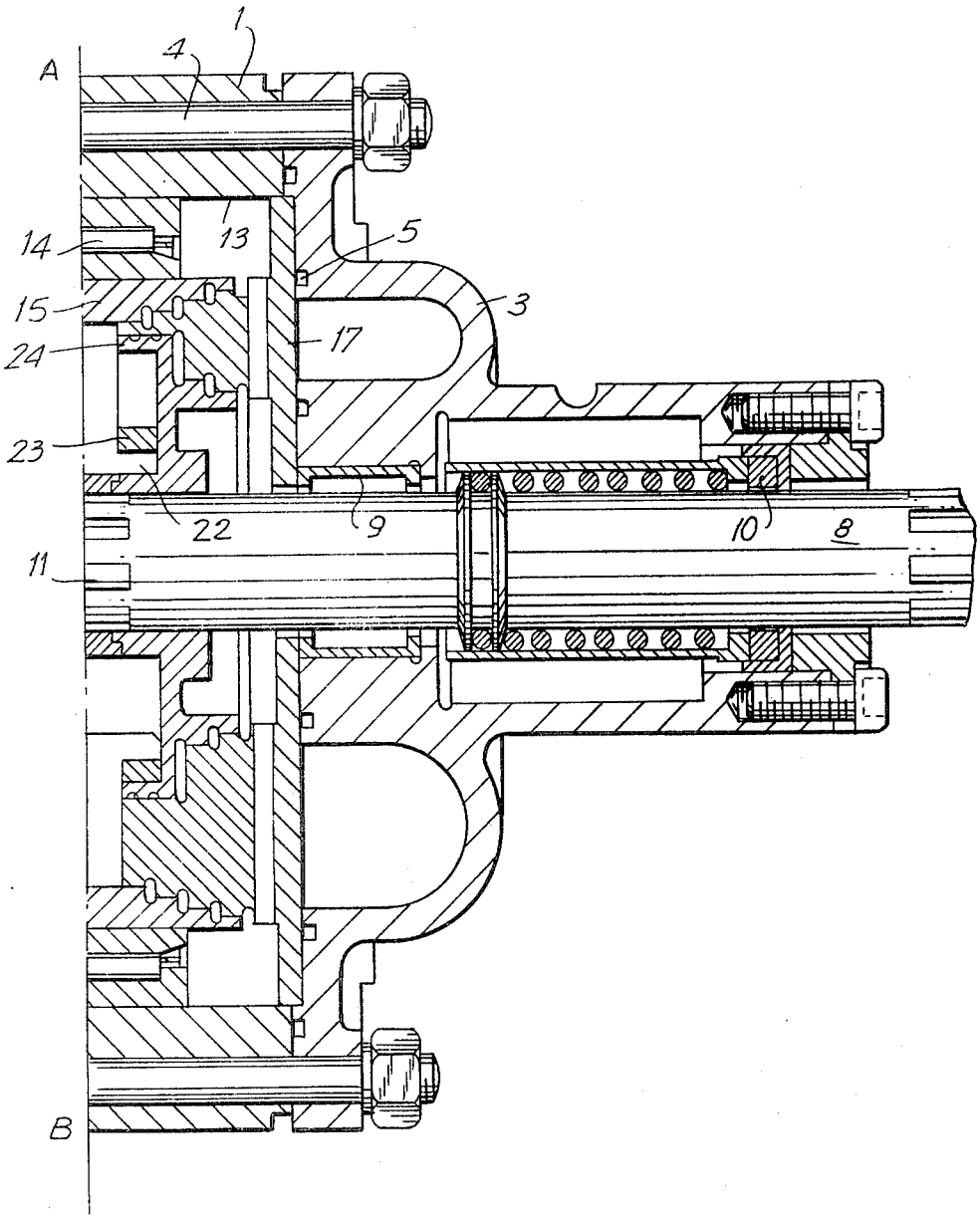
Figure 2:
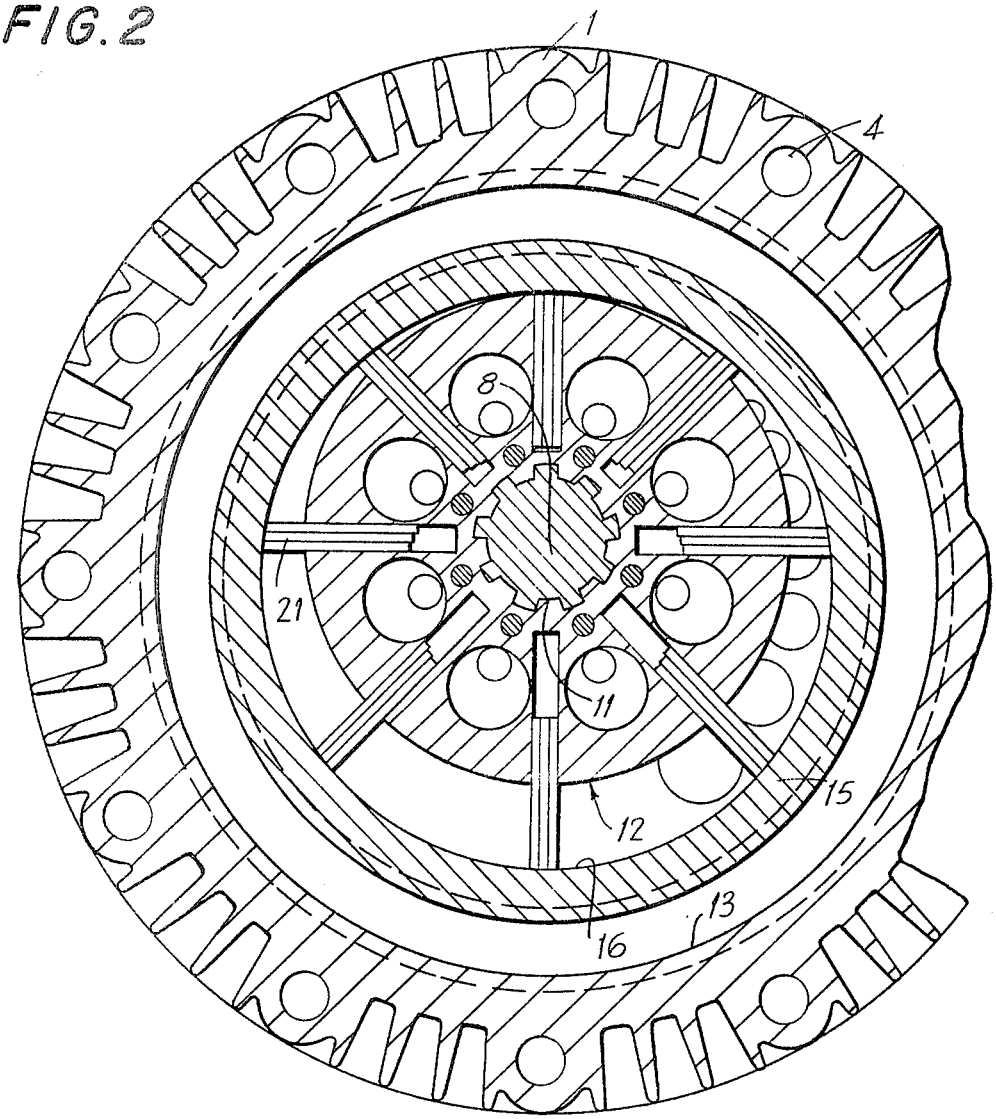
FIG. 2 is a transverse cross-sectional elevation through the same compressor.

In FIGS. 1 and 2 (which are somewhat schematic) there is shown a compressor for gases. This has an outer casing 1, whose opposite ends are closed off by means of individual cover plates 2 and 3, which are secured in position by means of bolts 4, a hermetic seal being formed by sealing rings 5. The casing 1 carries a cylindrical sleeve 15 by means of roller bearings 14, so that the sleeve 15 is freely rotatable. This sleeve 15 bounds a hollow cylindrical chamber and forms the stator of the machine, its inner cylindrical surface 16 is coaxial with the inner cylindrical surface 13 of the machine casing 1.

Cover plate 2 supports, by way of a radial needle bearing 6 and two axial roller bearings 7, one of the ends of shaft 8, which drives the machine. This shaft is supported at its opposite end, by cover plate 3 acting by way of a radial needle bearing 9 and a self-adjusting stuffing box 10. The shaft 8 may be provided, at its right-hand end as seen in FIG. 1B, with conventional means for coupling the shaft to a driving motor or suitable means for controlling and transmitting mechanical drive to the compressor.

Shaft 8 is splined, by means of a splined central portion 11, to a cylindrical rotor generally designated as 12, this rotor lying eccentrically relative to the inner cylindrical surface 13 of the outer casing 1. Hence the rotor is also eccentric relative to the hollow chamber bounded by the sleeve 15. As can be seen from FIG. 1 a generatrix of the rotor 12 contacts a generatrix of the inner surface 16.

The rotor 12 is equipped with axially extending vanes generally designated as 21 which project radially from the rotor. The vanes are displaceable within radial slots in the rotor allowing the circumferential edges of the vanes to contact the surface 16. This surface 16 co-operates with the rotor and vanes as is conventional in machines of this kind and the outer surface of the rotor 12, the inner surface 16 and the vanes 21 form working chambers which vary in size during rotation of the rotor 12.

The cover plate 2 and 3 secure individual end members 17 in position. These end members 17 are sealed to the cover plates by further sealing rings 5 and constitute end walls for the hollow cylindrical chamber. The members 17 are symmetrical about the transverse median plane of the machine and include annular projections 18 which engage between the adjacent ends of the sleeve 15 and of the rotor 12 with the interposition of labyrinth seals 19, so that these annular projections 18 assist in defining the working spaces of the machine. For reasons of simplicity no description has been given of other constructional details of parts which do not form part of the invention, such as the location of the ports, cooling and lubrication (and other) ducts, some of which can be identified in the drawings.

The mounting of the vanes to the rotor, and the construction of the parts of the rotor co-operating with the vanes will now be described in greater detail. In the embodiment shown in FIGS. 1 and 2 the vanes are each constituted by three parts sandwiched together and attached along an oblique line 20, so that the outer parts are thrust axially outwards towards the ends of the hollow chamber by centrifugal force acting on the central part. However, the manner of mounting would be equally applicable to single part vanes, and the embodiments shown (schematically) in FIGS. 3 onwards do in fact have single part vanes.

Each vane has lugs 22 projecting from the axially opposite ends of the vane, the lugs 22 being at a radially inward position adjoining the radially inner edge of the vane, (i.e. the edge nearest the shaft 8). The edge of each lug which faces radially outwardly constitutes an abutment surface, formed as a skid-like sliding surface.

Constraining members in the form of first and second rings 23 surround the lugs 22. The skid-like abutment surfaces at each end of the rotor bear on the terminal surfaces of a respective one of the rings 23. The parts just described are dimensioned in such a way that the assembly of vanes can only be centrifugal outwardly until the circumferential edges of the vanes just contact the internal surface 16 of the sleeve 15, thus preventing excessive contact pressure.

At each end of the rotor there is an end piece 24 sealingly engaging the end walls of the hollow chamber. For this, the outer surfaces of the end pieces 24 carry elements which co-operate with the labyrinth seals 19 on the projections 18. The vanes 21 extend axially between these spaced apart end pieces 24. The confronting faces of the end pieces 24 are hollow and define annular cavities 25, within each of which there is slidingly accommodated one assembly of a ring 23 and the lugs 22 surrounded thereby.

The radius of the outer cylindrical surface of cavity 25 is equal to the maximum eccentricity of the ring 23, so that this ring 23 can rotate, carried round by the vanes, totally independently of the rotor end pieces 24.

In accordance with what has been stated above, centrifugal force, which acts on the vanes during operation, is transmitted through the lugs 22 of these vanes to the rings 23 and the circumferential edges of the vanes always bear, subject to suitable tolerances, against the inner surface 16 of sleeve 15, which constitutes the stator of the machine. The constraining rings 23 control the contact between the vanes and the stator, and prevent excessive contact pressure which would give rise to appreciable friction.

Figure 3:
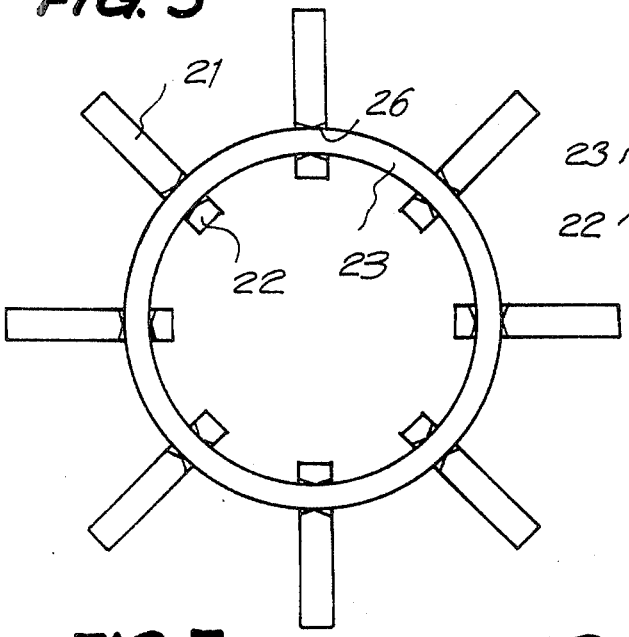
FIG. 3 shows a modification and is a view from one of the ends of a group of vanes, which are each of single-part construction.
Figure 4:
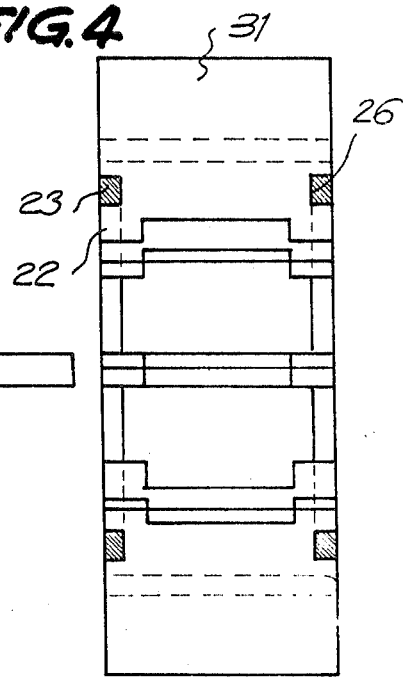
FIG. 4 is an elevational side view, with partial axial cross-sectioning, of the group of vanes shown in the previous Figure.

FIGS. 3 onwards show modified forms of machine which utilise the same constructional principle. FIGS. 3 and 4 show a machine in which the vanes have straight ends each with a recess 26 therein. A lug 22 is defined between each recess 26 and the radially inner edge of the vane. The edges of the lugs 22 which bound the recesses 26 constitute abutment surfaces. The constraining rings 23 are incorporated within these recesses 26 and in this case because the vanes are single part vanes the abutment surfaces are rounded or bevelled so as to allow the vanes to rock periodically relative to the rings as the vanes carry out their working strokes.

The rings 23 lie flush with the ends of the vanes and these ends and the rings sweep out, during rotation, a continuous smooth surface. A rotor of this form may be provided with end pieces having smooth confronting surfaces to lie adjacent the ends of the vanes or it may be incoporated in a small compressor where the ends of the vanes lie directly adjacent the end walls of the hollow working chamber.

Figure 5:
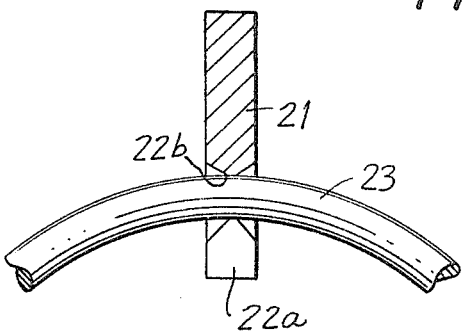
FIG. 5 shows a further modification and is a partial view, equivalent to FIG. 3, in the case of a further modification, with transverse cross-sectioning through the plane V—V of FIG. 6.
Figure 6:
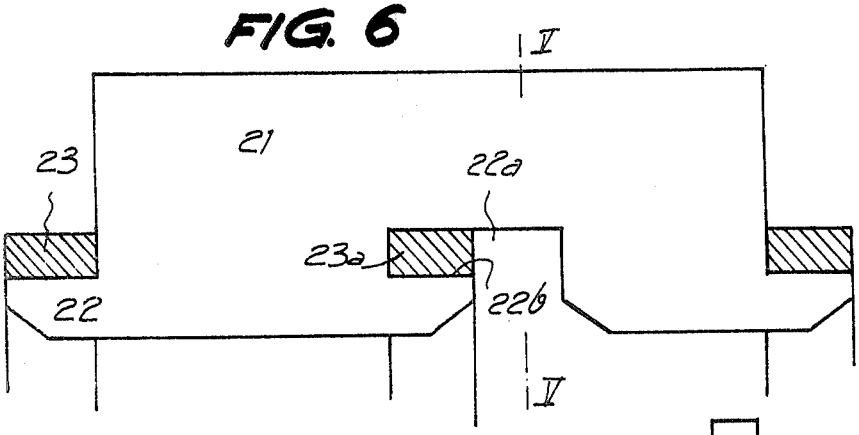
FIG. 6 is the corresponding lateral view.

FIGS. 5 and 6 show a form of rotor suitable for high peripheral speeds of the vanes 21. For high speeds the rotor 12 may be constructed in the form of two or more subsections which are rigidly attached together end to end by suitable mechanical means, for example, bolts or rivots, so as to form a one-piece element. This subdivision enables intermediate cavities to be provided in the interface of a pair of subsections. These additional cavities can be located at suitable longitudinal positions along the rotor and can be similar to those formed at the ends of the rotor and in which the first and second rings 23 are fitted.

Additional rings, such as the third ring 23*a* shown in FIGS. 5 and 6 can be accommodated in these additional cavities, the interface of a pair of adjoining subsections being aligned with each such additional ring. For fitting the third ring 23*a*, a cut-out 22*a* extends into each vane 21 from its radially inner edge. The cut-out 22*a* is provided with an axially extending zone 22*b* so that a further radially inward lug lies between the axially extending zone 22*b* of the cut-out and the radially inner edge of the vane. The outwardly facing edge of this lug constitutes an abutment surface bearing on the internal surface of the surrounding third ring 23*a* which is accommodated in the zones 22*b*.

By virtue of this constructional feature the effects due to centrifugal force are distributed to a larger number of constraining rings, thus reducing fatigue of the materials from which the parts are made and enabling greater angular speeds of the rotor and the machine to be achieved.

Figure 7:
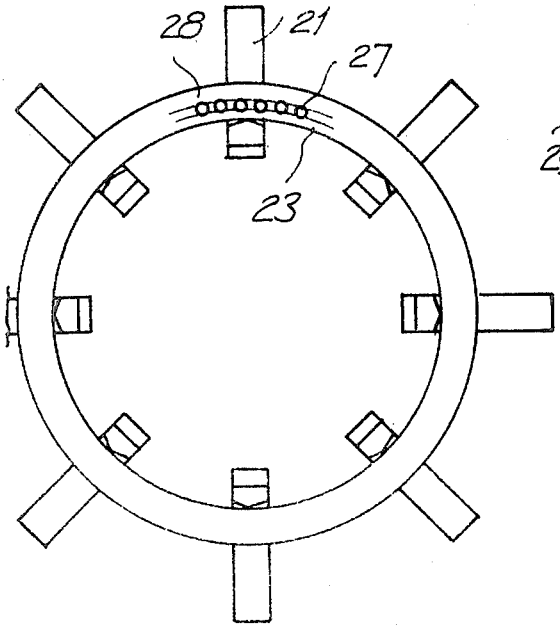
FIG. 7 is a view, equivalent to FIG. 3, showing of further modification.
Figure 8:
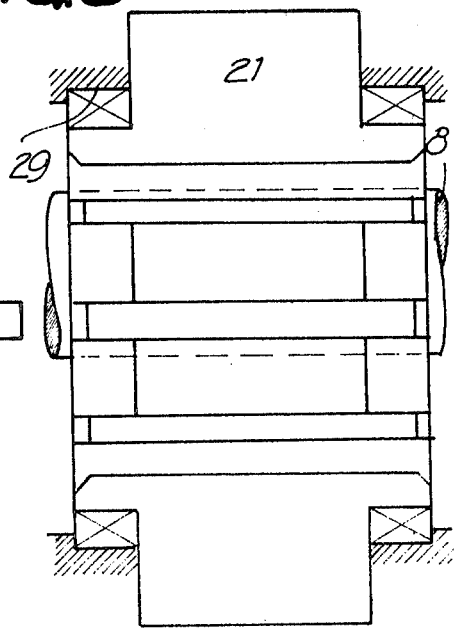
FIG. 8 also shows this modification, and is a view which is similar to that of FIG. 4.

Ideally the constraining rings should be maintained in a fixed position relative to the machine casing, and hence relative also to the hollow working chamber. For this it may be found appropriate, in certain cases, to utilise mechanically positive means to locate the constraining rings in position. Thus, FIGS. 7 and 8 show a machine in which the first and second constraining rings 23 are the inner rings of large ball or roller bearings 27, the outer rings 28 of each of these bearings fitting in associated seatings 29 on fixed parts of the machine such as the end members 17. The outer rings of the bearings then constitute support means to hold each of the rings 23 at a desired fixed location.

Wear taking place at the rubbing surfaces of the rings 23 and the lugs 22 will eventually cause the vanes 21 to bear against the surface 16 with too strong a contact pressure. For this reason, and in cases in which it is possible to anticipate that such wear will take place with comparative frequency, intermediate elements may be interposed between the lugs and the internal surfaces of the constraining rings. Such intermediate elements may be made of a different material from that of the lugs and rings.

Figure 9:
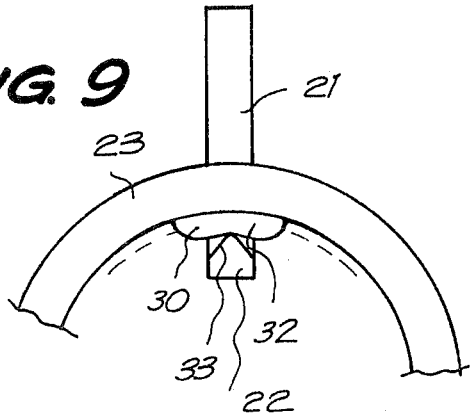
FIG. 9 is a detail looking into the end of a vane and illustrating the way in which the vane is mounted for sliding, by way of a runner, on a constraining ring.
Figure 10:
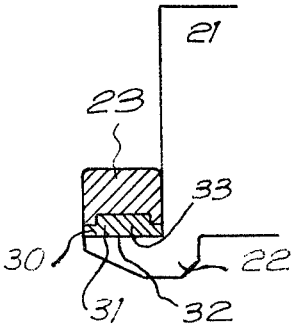
FIG. 10 is another detail, showing the end of the vane and the ring of the previous Figure in axial cross-section.

FIGS. 9 and 10 show an embodiment of machine in which slude bearing means, in the form of runners 30, are interposed between the abutment surfaces of the lugs 22 and the internal surfaces of the rings 23. The rings 23 each have a channel section internal surface, designated by reference 31. The runners 30 each have an arcuate surface to slide over the internal surface of a ring 23 and this arcuate surface has a profile which is of complementary shape to the channel section of the ring. It has a raised central part which slidingly fits into the channel, and the mating projecting and recesses limit relative axial movement between the ring and the runner.

The opposite face of each of the runners is formed in the manner of a knife block 32 with an axially extending groove to receive the axially extending apex of the bevelled abutment surface 33 of a lug 22. The lug and the runner thus form a knife-edge bearing.

As has been mentioned above, the circumferential edges of the vanes contact the cylindrical surface 16 of the hollow chamber subject to specific tolerances. Due to the eccentricity of the rotor relative to the axis of the stator surface 16, the vanes are only radial, relative to this surface 16, when they pass through the two diametrically opposite positions corresponding to the axial plane which also contains the axes of the rotor 12 and of the stator surface 16. Accordingly, at other any outer positions the vanes will not be radial relative to the surface 16, but will be in an inclined position, relative to the radial and will separate from the surface 16, as the constraining rings 23 prevent them from any further outward displacement.

In the majority of practical applications the maximum separation which occurs in such angular positions may be relatively small, for example in the case of machines of small size, or may not be of great importance, for example in the case of high working speeds or when the fluid introduced into the machine is of relatively high viscosity. If, nevertheless, tolerances are required which are smaller than those directly resulting from the geometry of the described form of construction, recourse may be had to various mechanical expedients for realising these smaller tolerances.

Figure 11:
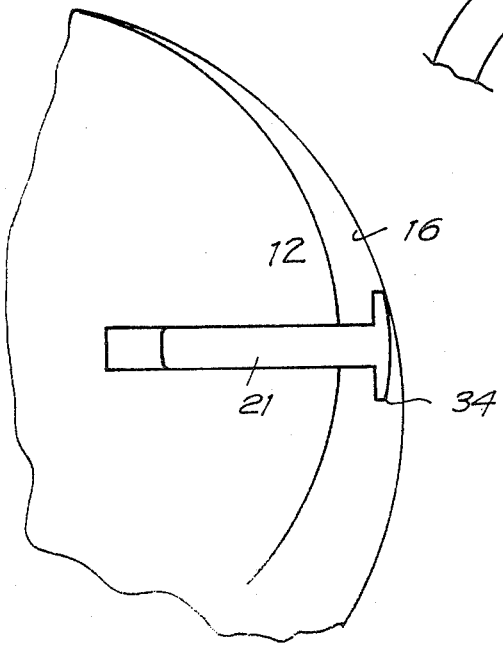
FIG. 11 illustrates one possible way of improving the way in which the vanes abut against the stator.

A solution consists in giving at least the circumferential edges of the vanes a greater thickness (i.e. circumferential width) than would otherwise be used, and machining the circumferential edge of the vanes to give them a profile such that in all the working positions of the vane which actually occur this circumferential edge always presents a generatrix which coincides with a generatrix of the surface 16. Such is the case in FIG. 11, in which the vane has a T-shaped transverse cross-section, so as to reduce weight. The top of the T is an enlarged head 34 having an arcuate circumferential surface.

The present invention can be embodied in other ways than those described above, which were given by way of non-limitative example only. Modifications and variations can be made without departing from the spirit and scope of this invention which is to be constructed and limited only by the appended claims.

I claim:

1. A fluid displacement machine having a pair of spaced apart end walls and a substantially cylindrical wall extending between them which walls together forms a substantially cylindrical hollow chamber, a rotor mounted for rotation within said chamber about an axis eccentric relative to the latter and being contiguous with said substantially cylindrical chamber wall along a generatrix thereof, said rotor having a pair of spaced apart end pieces sealingly engaging said end walls of said hollow chamber, said rotor also having vanes which extend axially between said end pieces, and which project substantially radially and which are displaceable in a substantially radial direction, said vanes having circumferential edges adapted to directly contact said substantially cylindrical chamber wall and thereby define working spaces which, during rotation of said rotor, move around said chamber while varying in volume, said vanes each havng a lug at a radially inward position at both axially opposite ends thereof and projecting axially from said axially opposite ends of said vanes, each of said lugs having an edge facing radially outwardly and providing an abutment surface spaced inwardly from said circumferential edge of said vane, and constraining members displaceable relative to said rotor and operatively associated with said vanes of said rotor to limit outward radial displacement thereof, said members determining limit positions for the vanes in which said circumferential edges of said vanes make only a desired degree of contact with said substantially cylindrical chamber wall, thereby preventing excessive contact pressure between said chamber wall and said circumferential edges, said constraining members including first and second rings each surrounding the lugs at a respective said end of said vanes, with said abutment surfaces bearing against the internal surfaces of said rings, characterized in that said end pieces form a part of said rotor so as to rotate coaxially therewith and are cup-shaped and each has a cavity in the confronting end faces thereof so that each of said first and second rings and said lugs surrounded thereby are received in said cavity in the adjacent said end pieces, and wherein each of said end pieces surrounds the adjacent said ring and said lug radially outwardly of and in sliding contact with said ring.

2. A fluid displacement machine as defined in claim 1, wherein each of said end pieces of said rotor has an axially extending portion having a radially inner surface, each of said rings having a radially outer surface which is radially outwardly surrounded by said radially inner surface of the adjacent said end piece and rests on said radially inner surface in sliding contact with the latter.

* * * * *